US005680691A

United States Patent [19]

Marom et al.

[11] Patent Number: 5,680,691

[45] Date of Patent: Oct. 28, 1997

[54] APPARATUS FOR REMOVING TIE WIRES FROM BALES

[75] Inventors: Avi Marom; Gideon Shahaf, both of Kibbutz Ein Hamifratz, Israel

[73] Assignee: I.M.A. Engineering Ltd., Mobile Post Oshrat, Israel

[21] Appl. No.: 503,458

[22] Filed: Jul. 17, 1995

[30] Foreign Application Priority Data

Jul. 18, 1994 [IL] Israel ..... 110355

[51] Int. Cl.[6] ..... B23P 23/00; B65B 69/00

[52] U.S. Cl. ..... 29/564.3; 29/426.4; 83/909

[58] Field of Search ..... 29/564.3, 33 R, 29/426.4, 33 F, 426.3, 564.7; 414/412; 83/809

[56] References Cited

U.S. PATENT DOCUMENTS

| | | | |
|---|---|---|---|
| 2,866,504 | 12/1958 | Syers, Sr. . | |
| 3,513,522 | 5/1970 | Thomson . | |
| 3,889,442 | 6/1975 | Grahn et al. . | |
| 4,348,801 | 9/1982 | Dumont et al. . | |
| 4,592,698 | 6/1986 | Semp et al. | 29/564.3 X |
| 4,718,157 | 1/1988 | Keyzers et al. | 29/426.4 |
| 4,773,148 | 9/1988 | Ohya et al. | 29/426.4 |
| 4,831,713 | 5/1989 | Hoden et al. | 29/564.3 |
| 4,835,836 | 6/1989 | Van Uitert . | |
| 4,841,619 | 6/1989 | Theriault . | |
| 4,850,087 | 7/1989 | Gronau | 29/33 R |
| 4,873,759 | 10/1989 | Burch . | |
| 4,929,141 | 5/1990 | Keesey et al. . | |
| 4,932,296 | 6/1990 | Boone . | |
| 5,052,098 | 10/1991 | Thumm | 29/564.3 |
| 5,163,216 | 11/1992 | Ercums et al. | 29/564.3 |
| 5,179,878 | 1/1993 | Kranefeld et al. . | |
| 5,228,628 | 7/1993 | Temburg et al. | 29/426.4 X |
| 5,454,683 | 10/1995 | Marom et al. | 83/809 X |

*Primary Examiner*—William R. Briggs
*Attorney, Agent, or Firm*—Ladas & Parry

[57] ABSTRACT

Apparatus for removing tie wires from bales includes a table for receiving a bale having a plurality of tie wires wrapped transversely around the bale, a rear stop engageable with the rear side of the bale when on the table, a main carriage movable transversely of the table towards and away from the rear stop and including a front stop engageable with the front of the bale for firmly holding the bale between it and the rear stop, and a cutter assembly movable longitudinally of the table adjacent to one of the stops for cutting the tie wires of a bale when firmly held between the two stops.

23 Claims, 11 Drawing Sheets

Fig.2

APPARATUS FOR REMOVING TIE WIRES FROM BALES

FIELD AND BACKGROUND OF THE INVENTION

The present invention relates to apparatus for removing tie wires from bales. The term tie wires is intended to include wires, bands, straps, and the like, of metal, plastic, fiber, etc., commonly applied around various types of bales, such as cotton bales, for storage or transportation of the bales.

Tie wires are commonly removed from bales by manually cutting the tie wires. However, this is an arduous and time-consuming task. A number of machines have been proposed for removing tie wires, but such known machines have not been found to be entirely satisfactory for one reason or another.

OBJECTS AND BRIEF SUMMARY OF THE INVENTION

An object of the present invention is to provide apparatus for removing tie wires from bales in an automatic and effecient manner.

According to one aspect of the present invention, there is provided apparatus for removing tie wires from bales, comprising: a table for receiving a bale having a plurality of tie wires wrapped transversely around the bale; a rear stop engageable with the rear side of the bale when on the table; a main carriage movable transversely of the table towards and away from the rear stop and including a front stop engageable with the front of the bale for firmly holding the bale between it and the rear stop; a cutter assembly movable longitudinally of the table adjacent to one of the stops for cutting the tie wires of a bale when firmly held between the two stops; a buckle detector for detecting buckles in the tie rods; and a rotatable orientation plate aligned with the table for receiving the bale and for orienting it such that the buckle faces away from the cutter assembly.

According to further features, the front stop carried by the main carriage comprises a plurality of vertical bars supported on the upper and lower parts of the main carriage and spaced longitudinally thereof.

According to further features in the described preferred embodiment, the cutter assembly is movable longitudinally of the table adjacent to the rear stop for cutting the tie wires; the apparatus further including a secondary carriage by the main carriage and movable thereon transversely of the table and of the main carriage; the secondary carriage including a stripper assembly engageable with the tie wires for stripping them from the bale by moving the secondary carriage transversely from an extended position adjacent the bale to a retracted position away from the bale after the tie wires have been cut by the cutter assembly.

According to additional features in the described preferred embodiment, the apparatus further includes a collector assembly for collecting the tie wires after having been cut and stripped from the bale, and for winding the collected tie wires around themselves into a ball. In the described preferred embodiment, the tie collector assembly is mounted on the main carriage adjacent to the retracted position of the secondary carriage.

According to still further features in the described preferred embodiment, the cutter assembly is movable along a track extending longitudinally of the table and includes a first cutter element having a finger receivable between the tie wire to be cut and the bale, and a second cutter element mounted to the first cutter element for pivotal movement with respect thereto to cut the tie wire when engaged by the first cutter element. According to still further features in the described preferred embodiment, the stripper assembly includes a plurality of stripper prongs mounted on opposite sides of the secondary carriage and movable towards and away from each other longitudinally of the table.

According to still further features in the described preferred embodiment, the tie wire collector assembly includes a fork engageable with the tie wires after having been cut by the cutter assembly and collected by the collector assembly, and a motor for rotating the fork to wind the tie wires engaged thereby into a ball.

As will be described more particularly below, apparatus constructed in accordance with the foregoing features is capable of removing tie wires from bales in a very efficient manner.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
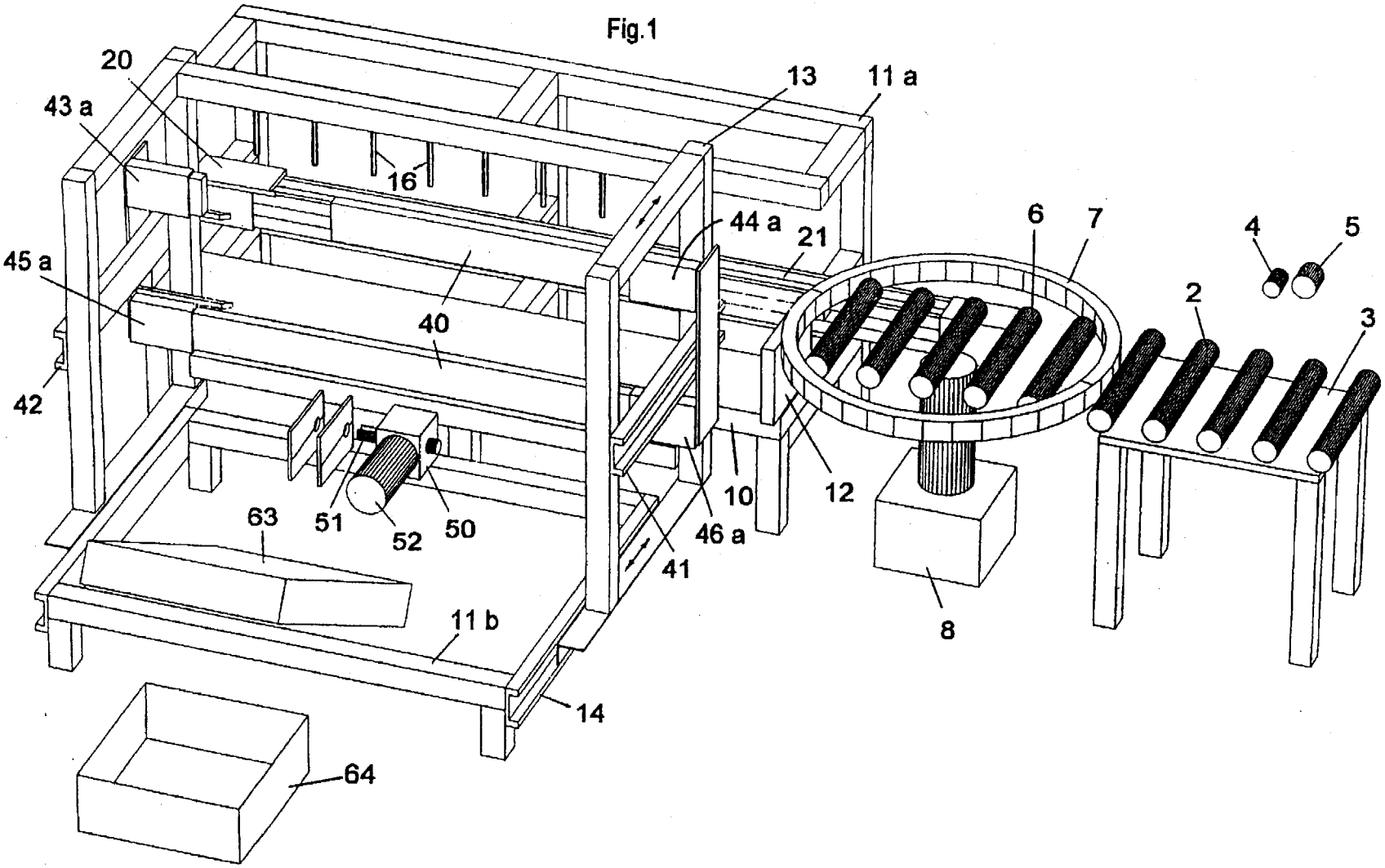
FIG. 1 is a pictorial illustration illustrating one form of apparatus constructed in accordance with the present invention.

The apparatus illustrated in the drawings is designed for removing the tie wires TW (FIG. 2) wrapped transversely around a bale B, e.g., of cotton. Such bales commonly also include an outer covering of plastic material which also has to be removed. The bale illustrated in FIG. 1 has already had the plastic covering removed, so that now to be removed are the tie wires TW.

Figure 2:
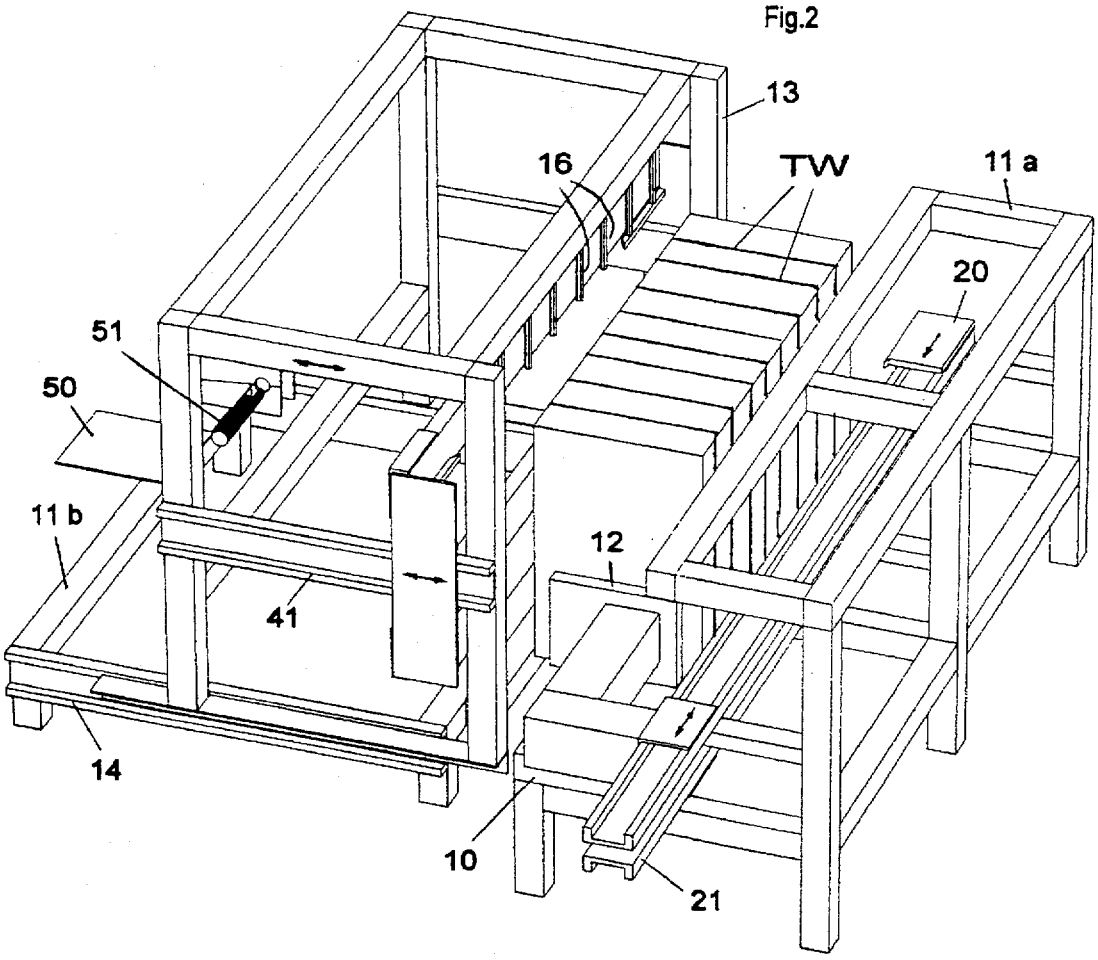
FIG. 2 is an illustration of the apparatus of FIG. 1 from the rear side of the apparatus.

The apparatus, as illustrated in FIG. 1, includes a plurality of conveyor rollers 2 rotatably mounted on an elevated plate 3 for receiving the bale. A pair of detectors 4, 5 are located laterally of the bale received on rollers 2. Detector 4 is an inductive-type detector for detecting the metal tie wires TW, and detector 5 is an ultrasonic-type detector for detecting the buckles (not shown but commonly provided in metal tie wires) in the tie wires on one side of the bale. Detector 5 assures that the bale, when introduced into the apparatus as to be described below, will be oriented such that a cutter assembly (to be described below) faces the side of the bale not provided with the buckles since the tie wires TW are to be cut on the buckle-free side of the bale.

The bale is fed from rollers 2 to rollers 6 supported on a rotatable plate 7. Plate 7 is rotated by a motor 8 to properly orient the bale before fed onto a horizontal table 10 of a fixed frame 11. The fixed frame 11 includes a rear frame section 11*a* at the rear side of horizontal table 10, and a front frame section 11*b* in front of the horizontal table.

The bale, when deposited on horizontal table 10, may be moved longitudinally of the table by a pusher plate 12 to properly position the bale on the table. The apparatus further includes a main carriage, generally designated 13, movable on rails 14 in the transverse direction towards and away from a rear stop 15 carried by the rear section 11*a* of fixed frame 11. A plurality of vertical bars 16 carried in longitudinaly-spaced relation on an upper part of the main carriage 13, and a plurality of vertical bars 17 (FIG. 5) carried in longitudinal spaced relation on a lower part of the main carriage 13, serve as front stops engageable with the front side of the bale for firmly holding the bale in place on table 10.

A cutter assembly, generally designated 20, is movable along a horizontal track 21 supported by the rear section 11*a* of fixed frame 11 under its rear stop 15. The arrangement is such that the cutter assembly is movable along the rear side of the bale on table 10 for the complete longitudinal length of the bale. The structure and manner of operation of the cutter assembly 20 are more particularly shown in FIGS. 3 and 4, which are top views of the cutter assembly.

Figure 3:
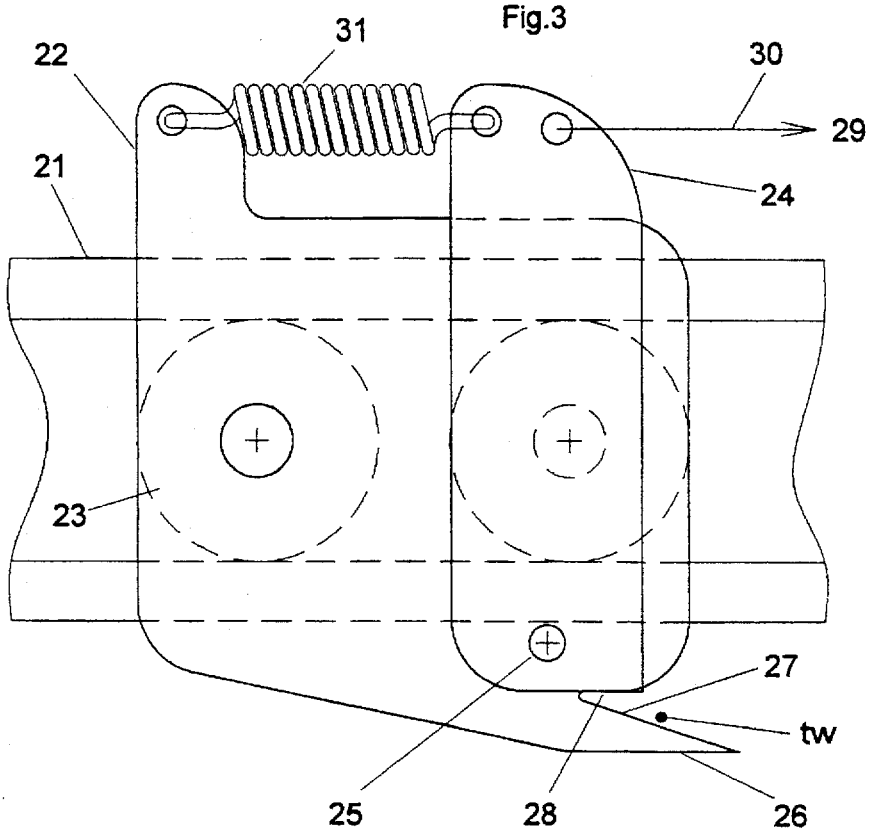
FIGS. 3 and 4 illustrate the construction and operation of the cutter assembly in the apparatus of FIGS. 1 and 2.
Figure 4:
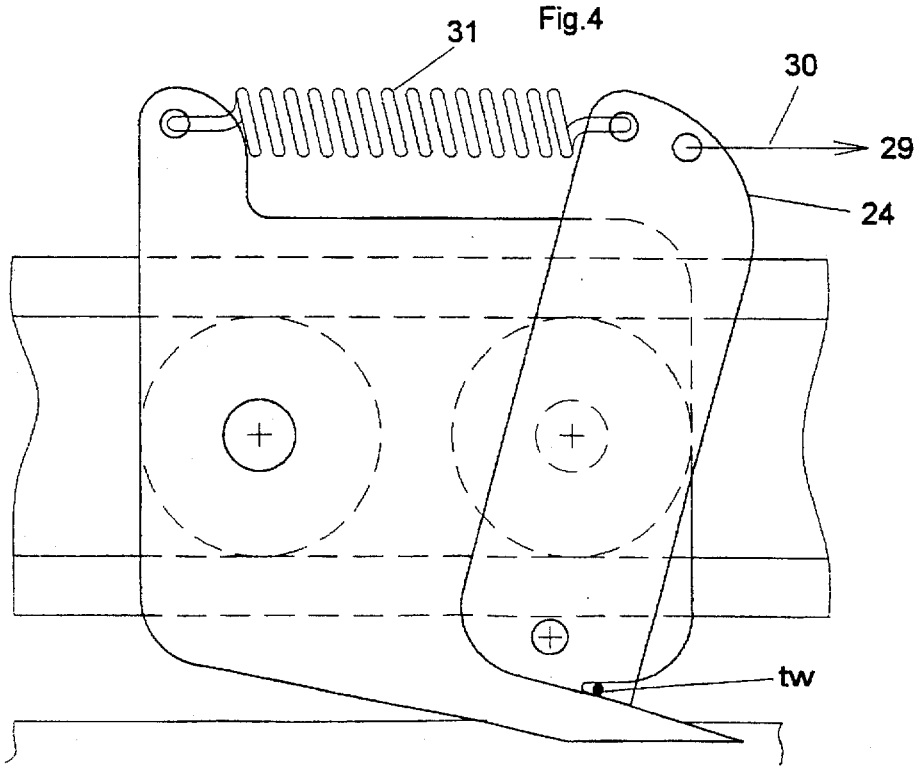

Thus, as shown in FIGS. 3 and 4, the cutter assembly 20 includes a cutter element 22 having a pair of rollers 23 movable along track 21. A second cutter element 24 is pivotally mounted about pivot axis 25 to cutter element 22. Cutter element 22 includes a finger 26 projecting on the bale side of the cutter assembly so as to be receivable between each tie wire TW and the bale B. The inner surface of finger 26 is formed with a cutting edge 27. Edge 28 of the second cutter element 24 is also a cutting edge and is normally inclined at an acute angle (e.g., about 30°) to cutting edge 27 in the normal position of cutter element 24.

The two cutter elements 22 and 24 are driven along track 21 by a motor 29 connected to cutter element 24 by a pull rod or wire 30 on the side of cutter element 24 opposite to the side at which the cutter element is pivotally mounted at pivot axis 25. Cutter element 24 is in turn connected to cutter element 22 by a strong spring 31 on the same side as the pull rod 30.

It will thus be seen that the operation of motor 29 will pull, via pull cable 30, element 24 along track 21, and with it cutter element 22. When finger 26 is received between a tie wire TW and the bale, the tie wire passes between cutting edges 27 and 28 until it reaches the nip between the two edges, at which time spring 31 yields to pivot cutter element 24 about pivot axis 25, thereby cutting the tie were TW between the two cutting edges 27 and 28.

A secondary carriage, generally designated 40, is mounted on tracks 41, 42 carried by the main carriage 13 and is movable in a transverse direction towards and away from horizontal table 10. Secondary carriage 40 carries a tie wire stripper assembly including four stripper prongs 43–46.

Figure 5:
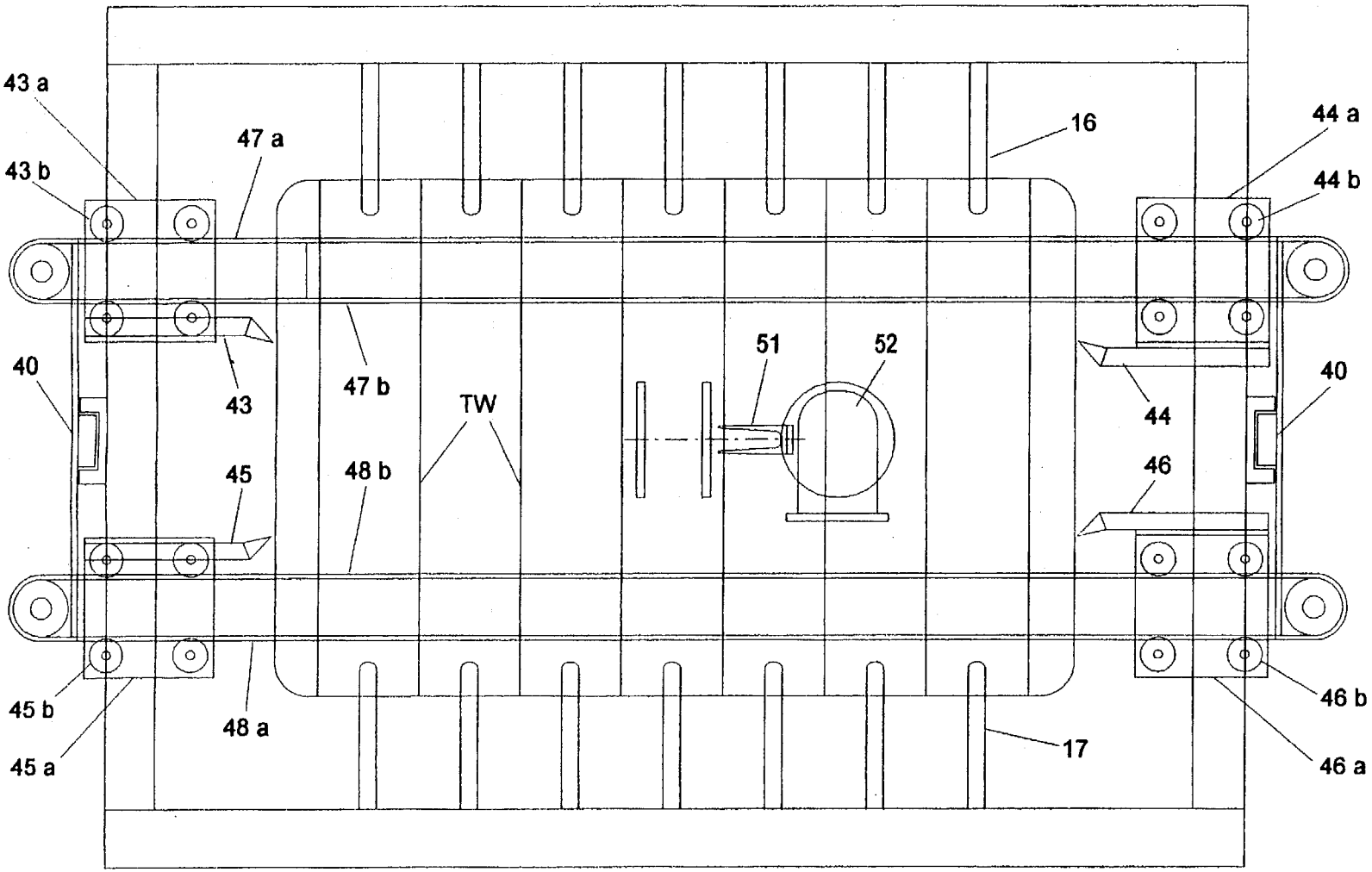
FIG. 5 is a rear view of the apparatus more particularly illustrating the operation of the stripper assembly for stripping the tie wires after having been cut.
Figure 6:
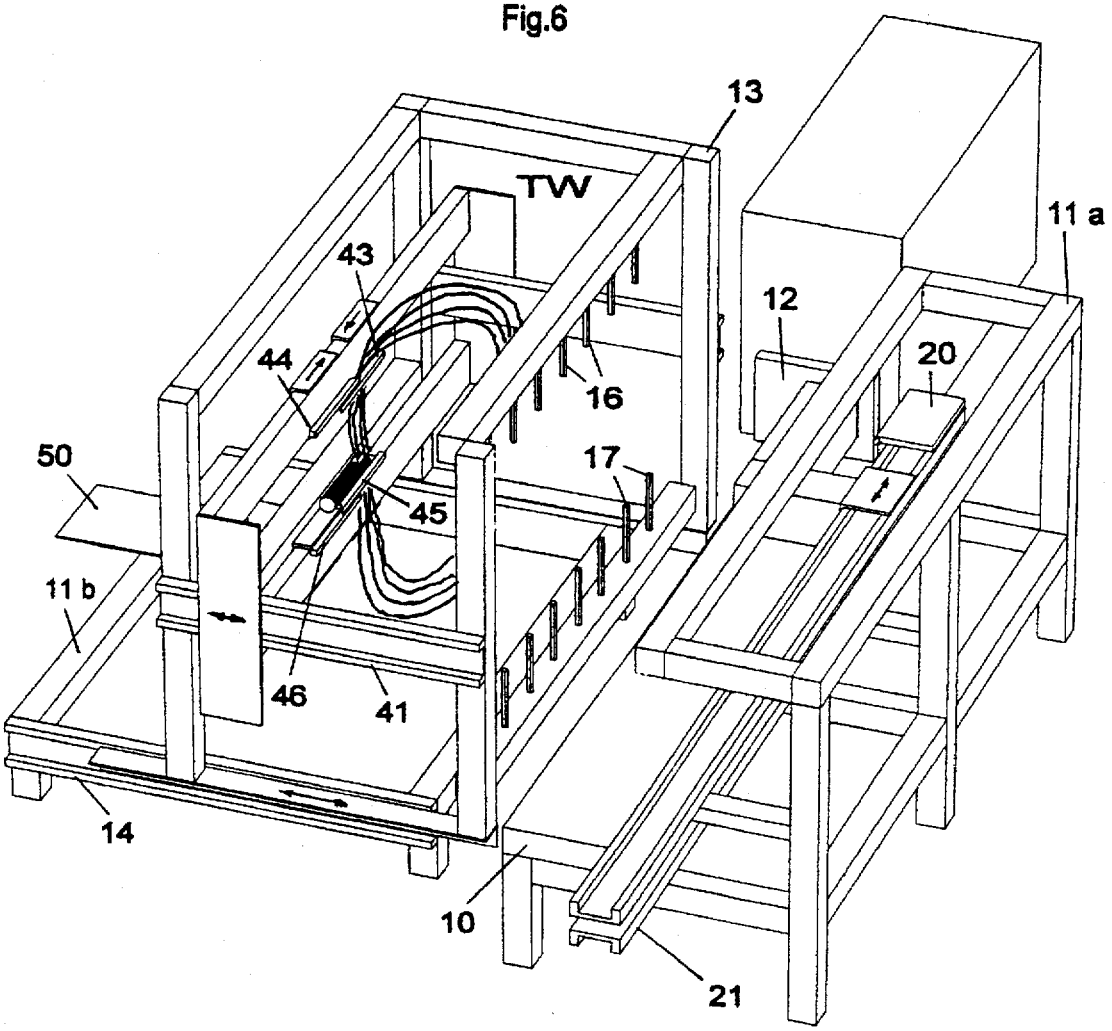
FIG. 6 is a pictorial illustration from the rear of the apparatus of FIGS. 1 and 2 more particularly illustrating the operation of the collector assembly for collecting the tie wires after they have been cut.
Figure 14:
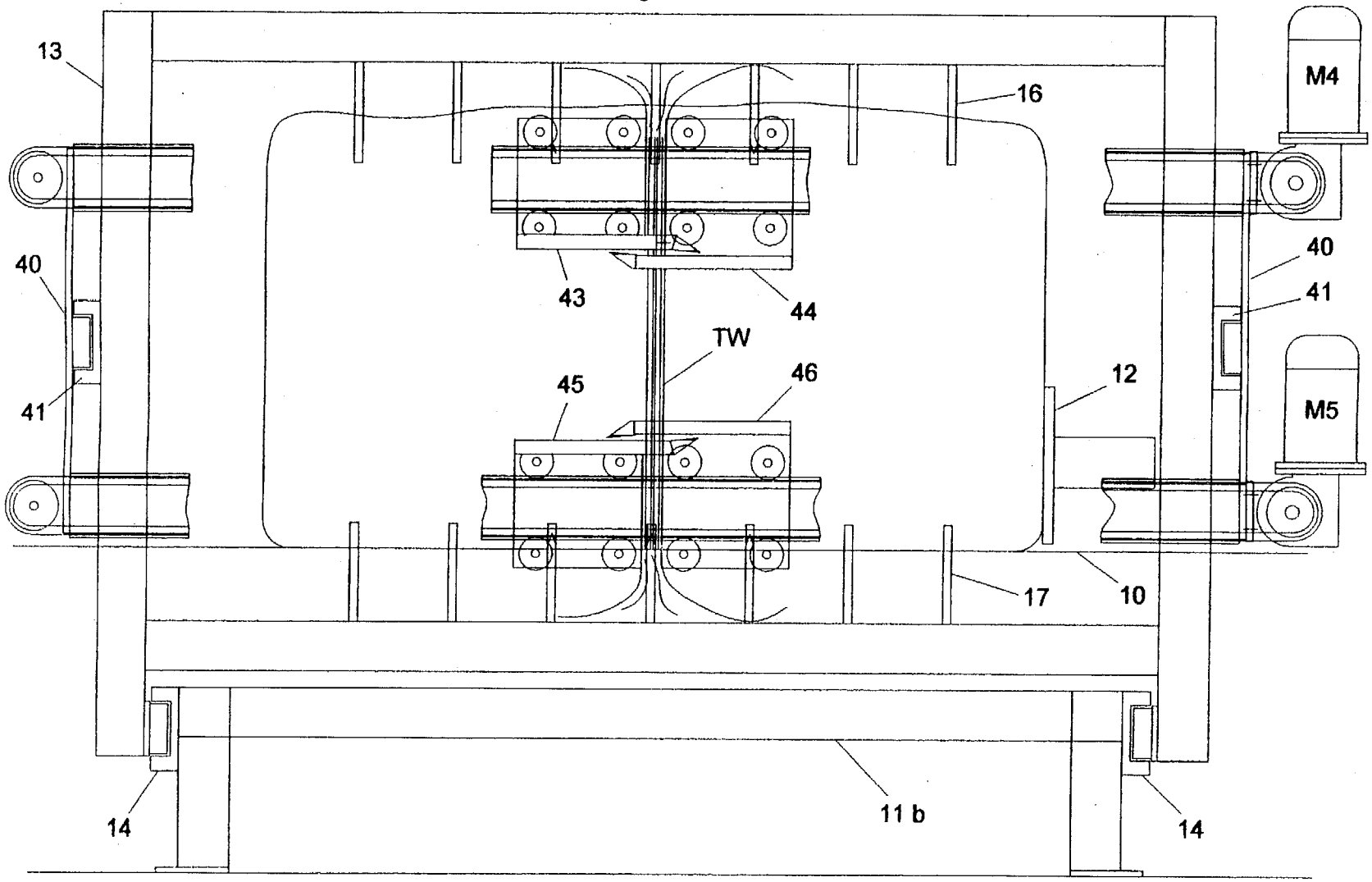

As best seen in FIG. 5, the upper stripper prongs 43 and 44 are mounted on opposite sides of the upper part of the secondary carriage 40 and are each carried by vertical plate 43*a*, 44*a*, having rollers 43*b*, 44*b*, movable on rails 47*a*, 47*b* extending transversely across the secondary carriage 40. The lower stripper prongs 45, 46 are similarly mounted on opposite sides of the lower part of the secondary carriage 40 and are carried by vertical plates 45*a*, 46*a*, having rollers 45*b*, 46*b* movable on tracks 48*a*, 48*b* extending transversely across the lower part of the secondary carriage 40. The two upper prongs 43, 44 are slightly out of alignment with each other, and similarly the two lower prongs 45 and 46 are slightly out of alignment with each other. Each pair of prongs will thus move to an overlapping position with respect to each other as seen in FIG. 14 between the tie wires TW and the bale B, after the tie wires have been cut. This clamps the tie wires between them, and strips the tie wires from the bale, as will be described more particularly below.

Figure 7:
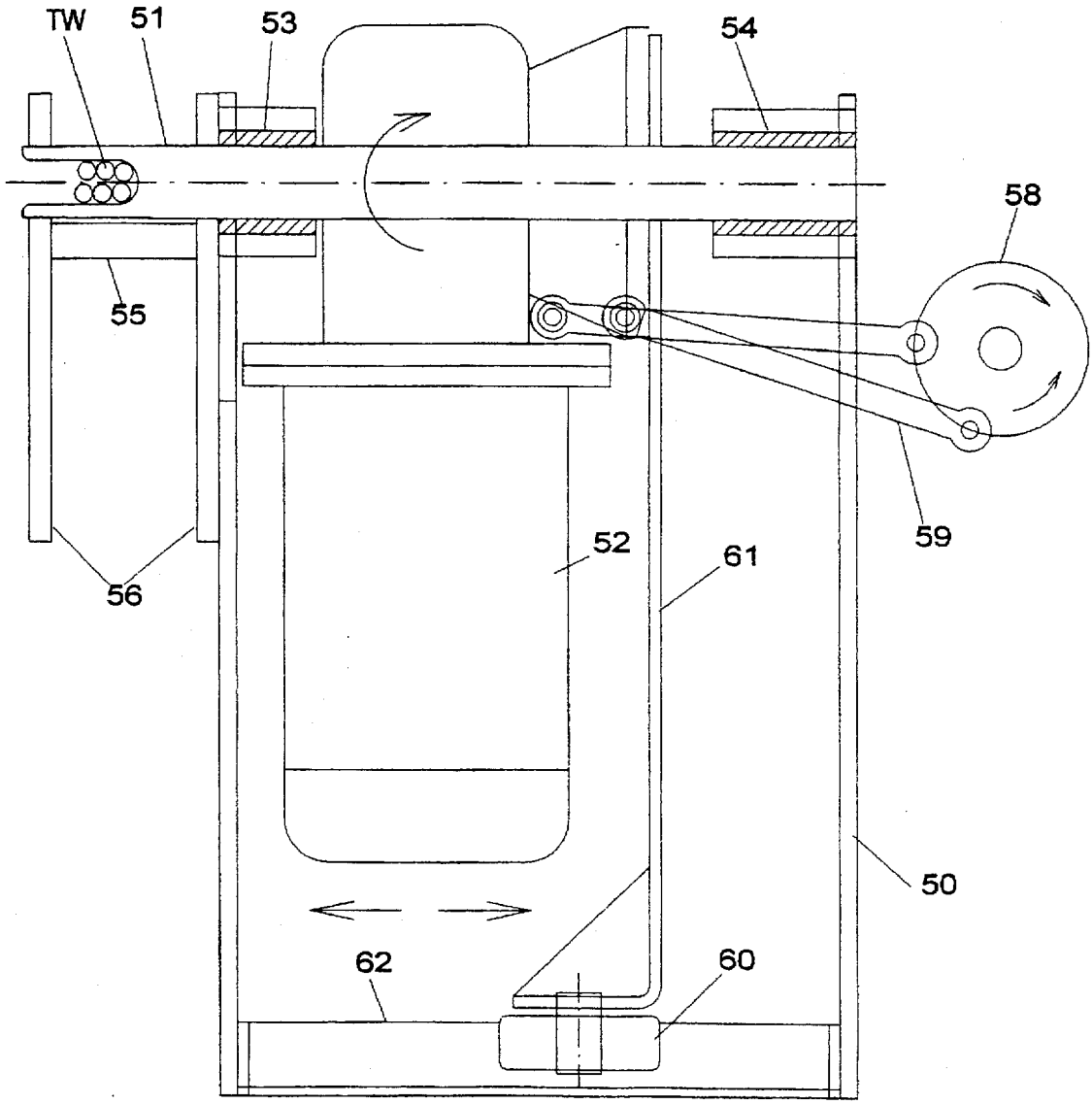
FIG. 7 more particularly illustrates the elements of the collector assembly which collects the tie wires, wind them into a ball, and strips the ball from the collector assembly.

The illustrated apparatus further includes a wire collector assembly, generally designated 50, carried by the front frame section 11*b* aligned with the stripper prongs 43–46 in the retracted position of the secondary carriage 40. As shown particularly in FIG. 7, the wire collector assembly 50 includes a fork 51 which is rotated about its own axis by a motor 52. Both the fork 51 and the motor 52 are supported by a pair of bearings 53, 54 mounted on the front section 11*b* of the fixed frame 11. The arrangement is such that the forked end 51*a* of fork 51 is in alignment with the center portion of the tie wires TW after having been cut by the cutter assembly 20, stripped from the bale, and clamped by the stripper prongs 43–46 of the stripper assembly. When the tie wires TW are thus received within the forked end 51*a* of the fork 51, and the fork is rotated by its motor 52, the fork will wind the tie wires TW into a ball. This is assured by the provision of a plate or roller 55 laterally of the forked end 51*a* of the fork.

The forked end 51*a* of fork 51 is normally located between a pair of plates 56, 57 mounted to the front section 11*b* of the fixed frame 11. Plate 57 serves to strip the tie wire ball from the forked end 51*a* of the fork. For this purpose, both the fork 51 and its motor 52 are shiftable parallel to the axis of fork 51 by an eccentric 58, including a crank arm 59, after the tie wire has been wound to a ball, so that the ball will be engaged by plate 57 to strip it from the forked end 51*a* of the fork. This lateral shifting of the fork 51 and its motor 52 by eccentric 58 is guided by a roller 60 secured to a link 61 carried by the fork 51 and motor 52 assembly. Roller 60 is movable along a surface 62 of the front section 11*b* of the fixed frame 11.

When the tie wire ball has been thus stripped from the end of fork 51, the ball drops onto a conveyor 63 (FIGS. 1, 15) which conveys it to a container 64 for receiving the wire balls.

OPERATION

The overall operation of the apparatus will now be described particularly with reference to FIGS. 8–15 illustrating various stages in the operation.

Figure 8:
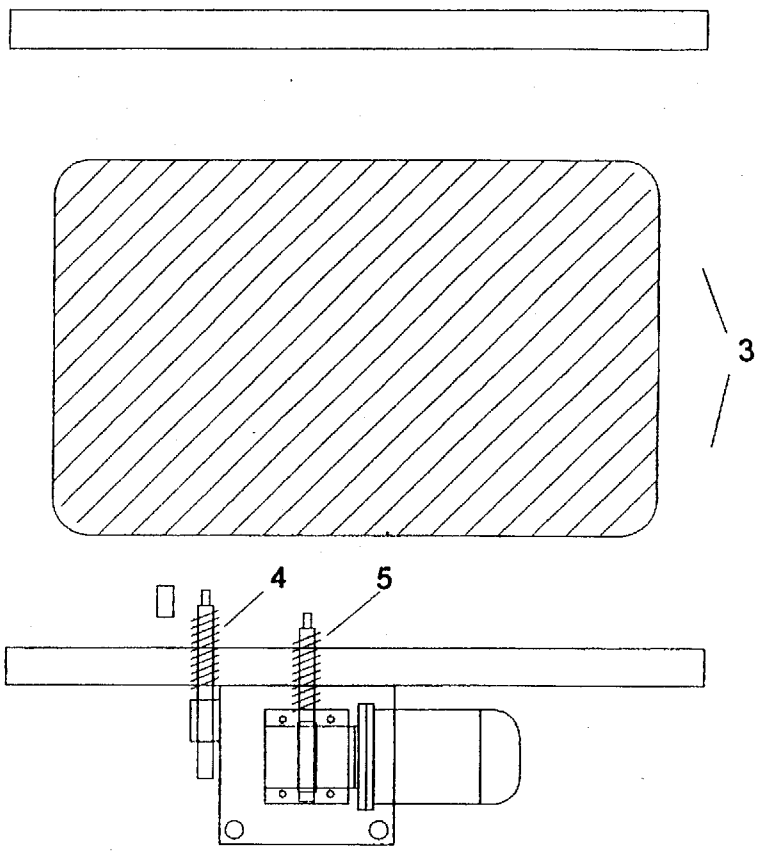
FIGS. 8–15 schematically illustrate the various stages in the overall operation of the apparatus of FIGS. 1–7.
Figure 9:
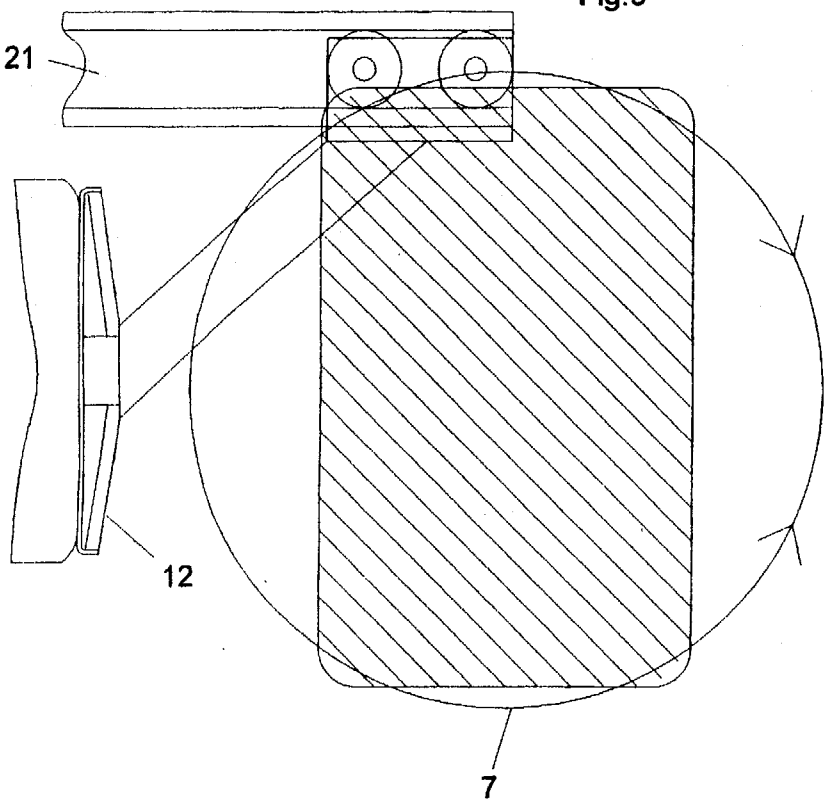
Figure 10:
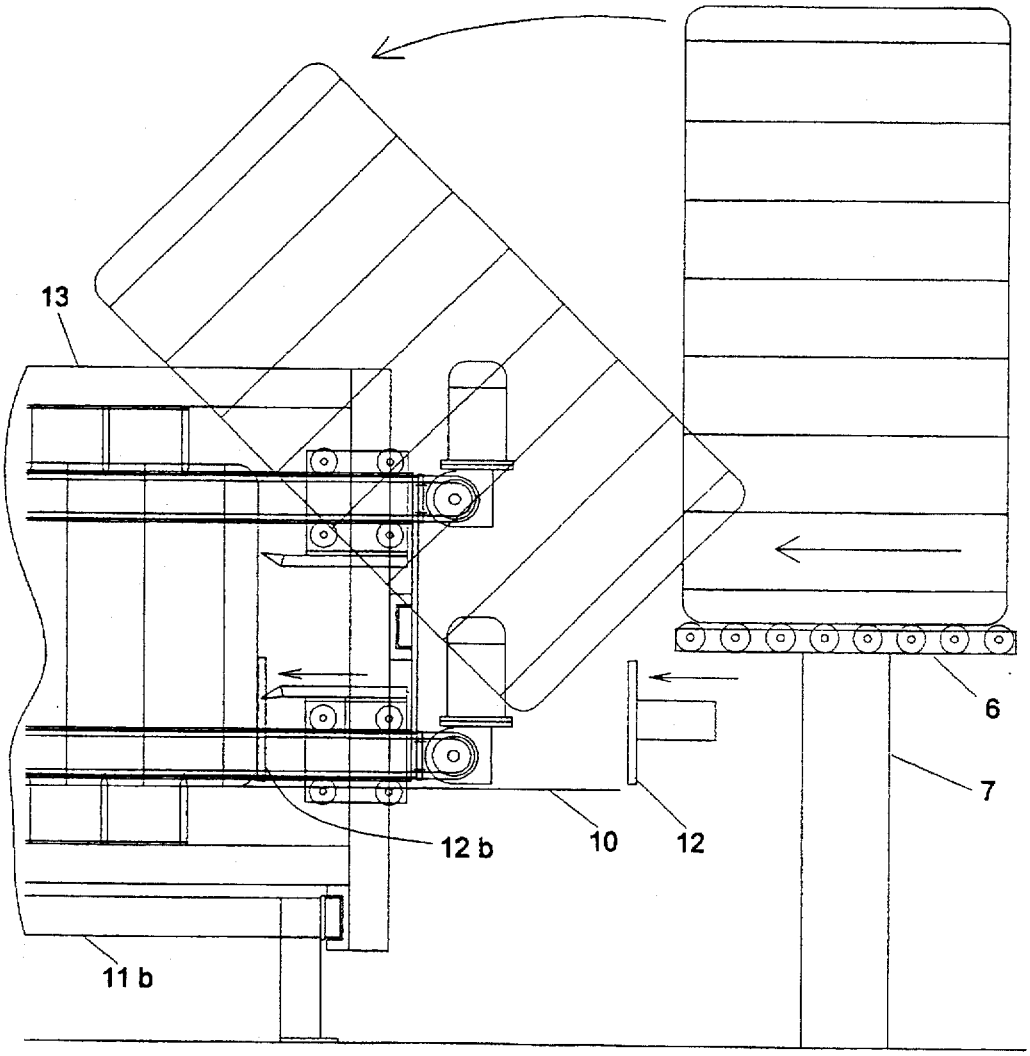

FIG. 8 illustrates the bale B (including the tie wires TW, FIG. 2, wrapped transversely around it) as initially received on rollers 2 (FIG. 1) of conveyor platform 3 which convey the bale past detectors 4 and 5. Detector 4 detects the tie wires TW, and detector 5 detects the buckles (not shown) of the tie wires (where metal tire wires are used). These detectors control the direction of rotation of rotary plate 7 (FIG. 9) to orient the bale so that when it is placed on the horizontal table 10 of the apparatus (FIG. 10), the side of the bale facing the cutter assembly 20 includes the tie wires TW but not the buckles.

At the time the bale is placed on the horizontal table 10, the main carriage 13 is in its open position, i.e., with its vertical bars 16, 17 spaced from the rear stop 15 of the fixed frame section 11*a* a distance greater than the width of the bale. As soon as the bale has thus been deposited on table 10, it is shifted longitudinally by pusher member 12 (FIG. 10) to a predetermined longitudinal position on the table; and then the main carriage 13 is moved to its closed position wherein its vertical bars 16, 17 engage the front side of the bale and press the bale against the rear stop 15 of the fixed frame section 11*a* (FIG. 11).

Figure 12:
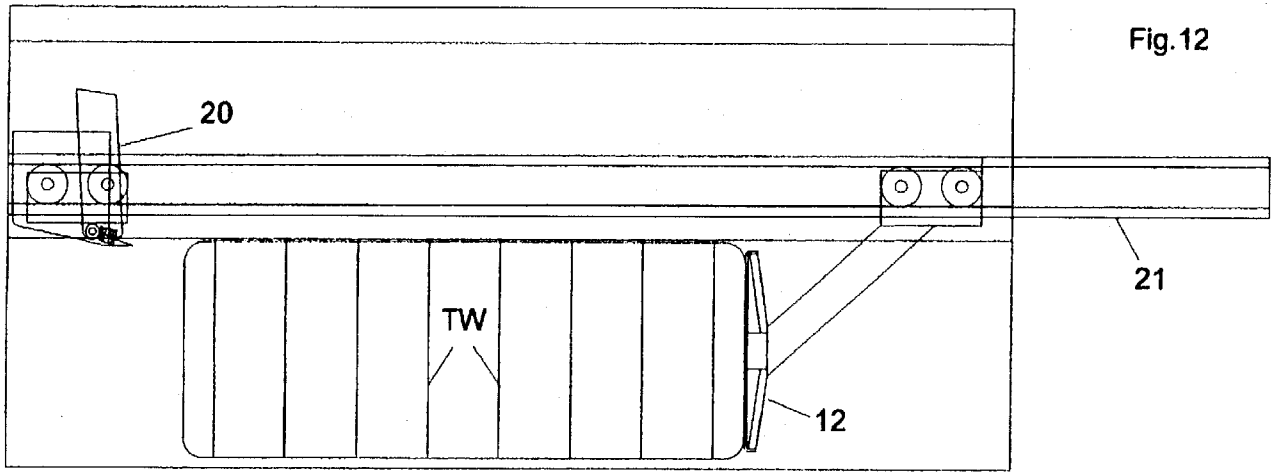
Figure 13:
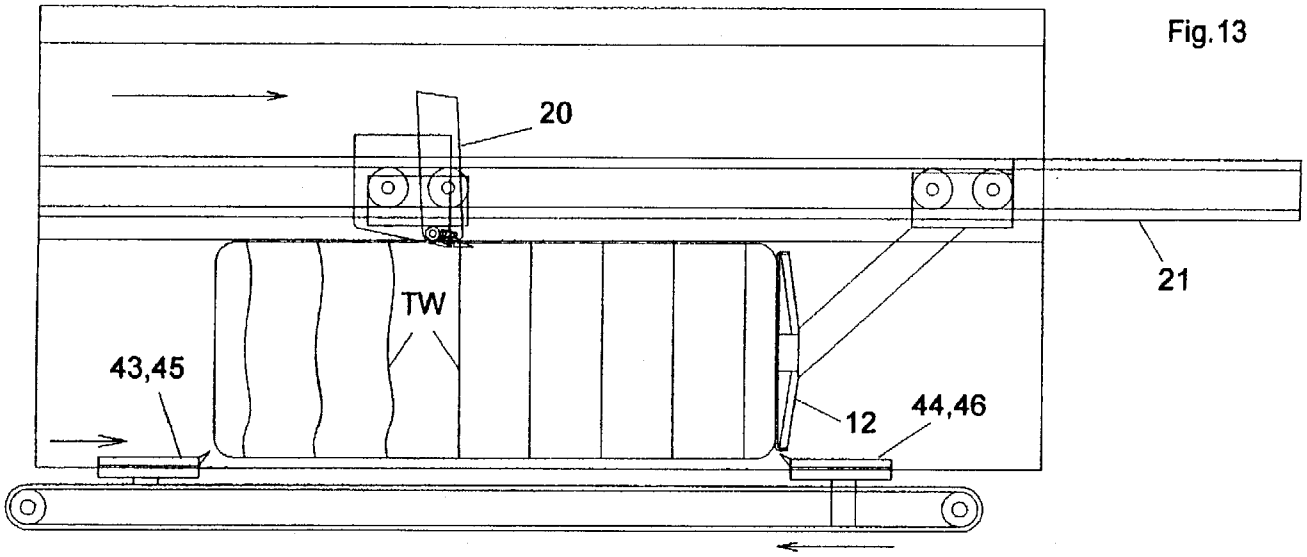

In this position of the bale, the cutter assembly 20 is aligned with an intermediate portion of the tie wires TW of the bale. The cutter assembly is then actuated by motor 29 (FIG. 3) to move the assembly in a longitudinal direction along its track 21 (FIGS. 12 and 13). As described earlier particularly with respect to FIGS. 3 and 4, as the cutter assembly is thus moved along track 21, finger 26 of cutter element 22 is received between each tie wire TW and the bale (FIG. 3), which causes cutter element 24 to pivot to cut the tie wire (FIG. 4). In this manner, all the tie wires TW wrapped transversely around the bale are cut in succession as the cutter assembly 20 moves longitudinally of the bale along its track 21.

After the tie wires TW have thus been cut, the secondary carriage 40 is moved to its extended position with respect to the main carriage 13. In this position, the prongs 43–46, of the stripping assembly, become aligned with the front side of the bale, particularly between the tie wires TW and the bale. The motors for the four prongs 43–46 are then actuated to drive the two upper prongs 43, 44 towards each other, and the two lower prongs 45, 46, towards each other, into overlapping relations as shown in FIG. 14. When the prongs are so driven, they clamp between them the tie wires TW on the side of the bale opposite to that at which the tie wires were cut by the cutter assembly 20.

Figures 11, 15:
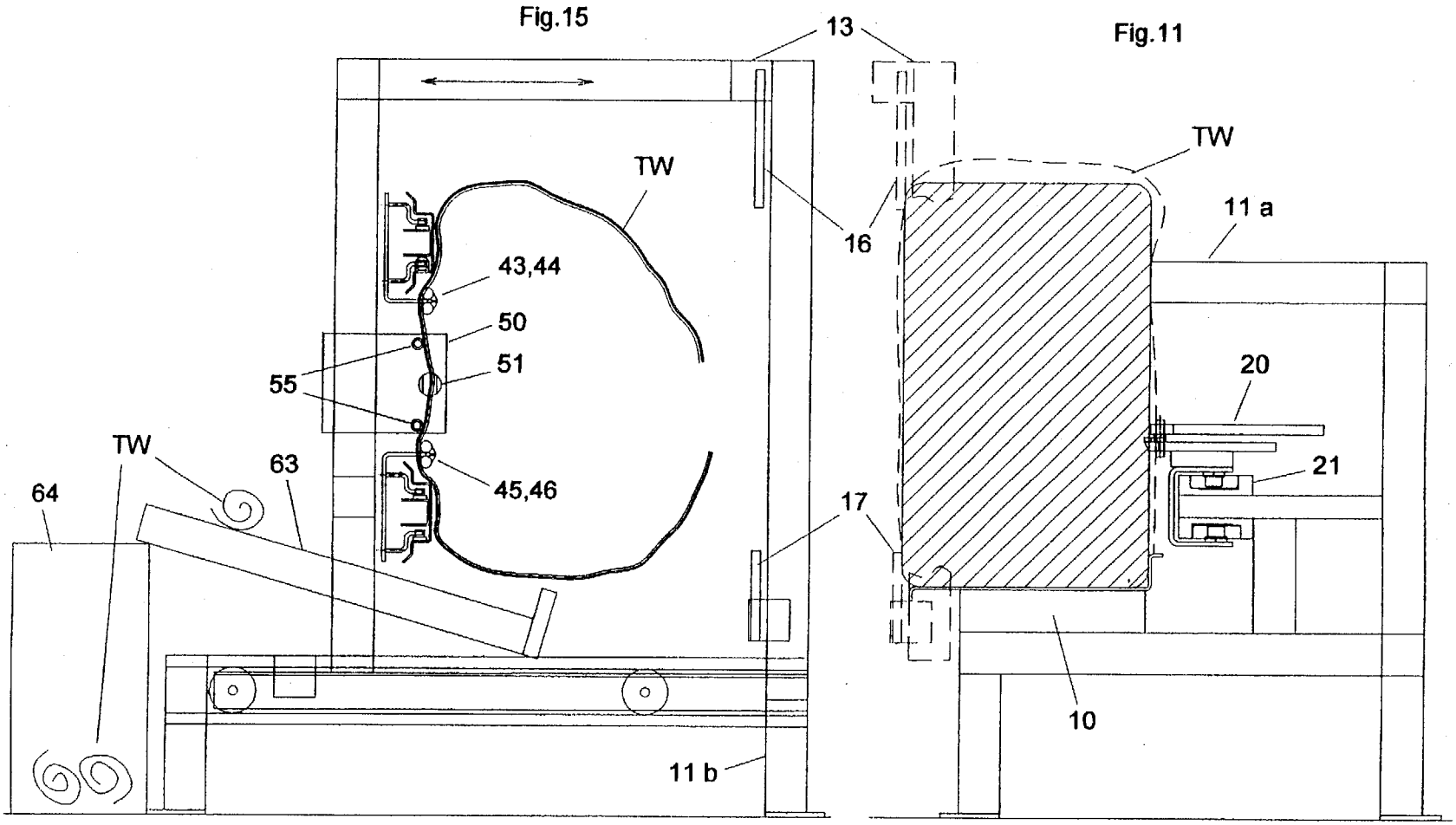

When the tie wires TW are so clamped, the secondary carriage 40 is then moved to its retracted position (FIG. 15). When the secondary carriage is so moved, the primary carriage 13 holds the bale between the vertical bars 16, 17 of the primary carriage engaging the front side of the bale, and the rear stop 15 of the rear frame section 11*a* engaging the rear side of the bale. This movement of the secondary carriage to its retracted position thus strips the tie wires TW from the bale.

When the secondary carriage 40 is in its retracted position, the tie wires TW clamped by the stripping prongs 43–46 are in alignment with fork 51 of the collector assembly 50 supported on the front section 11*b* of the fixed frame 11. The fork 51 is then shifted laterally by its eccentric drive 58 to receive the tie wires TW within its forked end 51*a* (FIG. 7), whereupon motor 52 is actuated to rotate the fork 51 and thereby to wind the tie wires into a ball. After the tie wires have been so wound, eccentric 58 shifts the fork 51, including its motor 52, parallel to the axis of the fork, to cause stripping plate 57 to strip the ball of tie wires from the forked end 51*a* and to drop it onto conveyor 63 (FIG. 15). Conveyor 63 then conveys the ball to a receptacle 64.

While the invention has been described with respect to one preferred embodiment, it will be appreciated that this is set forth merely for purposes of example, and that many other variations, modifications and applications of the invention may be made.

We claim:

1. Apparatus for removing tie wires from bales, comprising: a table for receiving a bale having a plurality of tie wires wrapped transversely around the bale; a rear stop engageable with the rear side of the bale when on said table; a main carriage movable transversely of the table towards and away from said rear stop and including a front stop engageable with the front of the bale for firmly holding the bale between it and the rear stop; a cutter assembly movable longitudinally of the table adjacent to one of said stops for cutting the tie wires of a bale when firmly held between the two stops; a buckle detector for detecting buckles in the tie wires; and a rotatable orientation plate aligned with said table for receiving the bale and for orienting it such that such buckles face away from said cutter assembly.

2. The apparatus according to claim 1, wherein said cutter assembly is movable longitudinally of the table adjacent to said rear stop for cutting said tie wires; said apparatus further including a secondary carriage carried by said main carriage and movable thereon transversely of the table and of the main carriage; said secondary carriage including a stripper assembly engageable with the tie wires for stripping them from the bale by moving the secondary carriage transversely from an extended position adjacent the bale to a retracted position away from the bale after the tie wires have been cut by the cutter assembly.

3. The apparatus according to claim 2, wherein said apparatus further includes a collector assembly for collecting the tie wires after having been cut and stripped from the bale, and for winding the collected tie wires around themselves into a ball.

4. The apparatus according to claim 3, wherein said collector assembly is mounted on said main carriage adjacent to said retracted position of the secondary carriage.

5. The apparatus according to claim 1, wherein said cutter assembly is movable along a track extending longitudinally of said table and includes a first cutter element having a finger receivable between the tie wire to be cut and the bale, and a second cutter element mounted to said first cutter element for pivotal movement with respect thereto to cut each tie wire when engaged by said first cutter element.

6. The apparatus according to claim 5, wherein said cutter assembly is movable along said track by a motor connected to said second cutter element by a pull coupling, said second cutter element being connected to said first cutter element by a spring coupling which yields when the finger of the first cutter element is received between the bale and the tie wire to be cut, to cause the second cutter element to pivot and thereby to cut the tie wire between it and the first cutter element.

7. The apparatus according to claim 2, wherein said stripper assembly includes a plurality of stripper prongs mounted on opposite sides of said secondary carriage and movable towards and away from each other longitudinally of the table.

8. The apparatus according to claim 7, wherein there are a pair of upper stripper prongs mounted on opposite sides of the upper part of said secondary carriage, and a pair of lower stripper prongs mounted on opposite sides of the lower part of said secondary carriage.

9. The apparatus according to claim 7, wherein each of said stripper prongs is driven along a track extending longitudinally of the secondary carriage.

10. The apparatus according to claim 3, wherein said collector assembly includes a fork engageable with said tie wires after having been cut by said cutter assembly and collected by said collector assembly, and a motor for rotating said fork to wind the tie wires engaged thereby into a ball.

11. The apparatus according to claim 10, wherein said collector assembly further includes a shifter device for shifting said fork parallel to its axis, and a stripper plate engaged by the ball wound on the fork when the fork is so shifted for stripping the ball from the fork.

12. The apparatus according to claim 11, wherein said collector assembly further includes a conveyor underlying said stripper plate for receiving the ball stripped thereby and for conveying it away from said table.

13. Apparatus for removing tie wires from bales, comprising: a table for receiving a bale having a plurality of tie wires wrapped transversely around the bale; a rear stop engageable with the rear side of the bale when on said table; a main carriage movable transversely of the table towards and away from said rear stop and including a front stop engageable with the front of the bale for firmly holding the bale between it and the rear stop; and a cutter assembly movable longitudinally of the table adjacent to one of said stops for cutting the tie wires of a bale when firmly held between the two stops; wherein said front stop carried by said main carriage comprises a plurality of vertical bars supported on the upper and lower parts of the main carriage and spaced longitudinally thereof.

14. The apparatus according to claim 13, wherein the apparatus further includes a pusher movable longitudinally of the table for pushing the bale to a predetermined position thereon.

15. The apparatus according to claim 13, wherein the apparatus further includes a buckle detector for detecting buckles in the tie wires, and a rotatable orientation plate aligned with said table for receiving the bale and for orienting it such that said buckles face away from said cutter assembly.

16. Apparatus for removing tie wires from bales, comprising: a table for receiving a bale having a plurality of tie wires wrapped transversely around the bale; a cutter assembly movable along a track extending longitudinally of said table and including a first cutter element having a finger receivable between the tie wire to be cut and the bale, and a second cutter element mounted to said first cutter element for pivotal movement with respect thereto to cut the tie wire when engaged by said first cutter element; and a stripping assembly comprising a plurality of stripper prongs movable towards and away from each other longitudinally of the table on the side thereof opposite to that of said cutter assembly.

17. The apparatus according to claim 16, wherein said cutter assembly is movable along said track by a motor connected to said second cutter element by a pull coupling, said second cutter element being connected to said first cutter element by a spring coupling which yields when the finger of the first cutter element is received between the bale and the tie wire to be cut to cause the second cutter element to pivot and thereby to cut the tie wire between it and the first cutter element.

18. The apparatus according to claim 13, wherein the apparatus further includes a stripping assembly comprising a plurality of stripper prongs movable towards and away from each other longitudinally of the table on the side thereof opposite to that of said cutter assembly.

19. The apparatus according to claim 18, wherein there are a pair of upper stripper prongs movable towards and away from each other, and a pair of lower stripper prongs movable towards and away from each other.

20. The apparatus according to claim 18, wherein each of said stripper prongs is driven along a track extending longitudinally of the table.

21. The apparatus according to claim 18, wherein the apparatus further includes a collector assembly comprising a fork engageable with said tie wires after having been cut by said cutter assembly and collected by said collector assembly, and a motor for rotating said fork to wind the tie wires engaged thereby into a ball.

22. The apparatus according to claim 21, wherein said collector assembly further includes a shifter device for shifting said fork parallel to its axis, and a stripper plate engaged by the ball wound on the fork when the fork is so shifted for stripping the ball from the fork.

23. The apparatus according to claim 22, wherein said collector assembly further includes a conveyor underlying said stripper plate for receiving the ball stripped thereby and for conveying it away from said table.

* * * * *